US007028748B2

(12) United States Patent
Kolbeck et al.

(10) Patent No.: US 7,028,748 B2
(45) Date of Patent: Apr. 18, 2006

(54) CAST-ROLLING PLANT

(75) Inventors: Dietmar Kolbeck, Steinfeld (DE); Hans-Günter Wobker, Bramsche (DE); Klaus Maiwald, Parnamirim/Recife-PE (BR)

(73) Assignee: KM Europa Metal AG, Osnabruck (DE)

( * ) Notice: Subject to any disclaimer, the term of this patent is extended or adjusted under 35 U.S.C. 154(b) by 0 days.

(21) Appl. No.: 11/036,397

(22) Filed: Jan. 14, 2005

(65) Prior Publication Data

US 2005/0150630 A1 Jul. 14, 2005

(30) Foreign Application Priority Data

Jan. 14, 2004 (DE) ..... 10 2004 002 124

(51) Int. Cl.
*B22D 11/06* (2006.01)

(52) U.S. Cl. ..... 164/428

(58) Field of Classification Search ..... 164/428, 164/448

See application file for complete search history.

(56) References Cited

U.S. PATENT DOCUMENTS 4,936,374 A * 6/1990 Pareg ..... 164/503
5,207,265 A * 5/1993 Hasegawa et al. ..... 164/428
5,495,886 A * 3/1996 Kolesnichenko ..... 164/467

* cited by examiner

*Primary Examiner*—Len Tran
(74) *Attorney, Agent, or Firm*—Kenyon & Kenyon LLP

(57) ABSTRACT

A plant for the continuous casting of aluminum strip, according to current construction type, has two counterrotating continuous casting rolls (1, 2), between which a casting gap (4) is formed. According to the present invention, the 1. continuous casting roll (1) is made of a copper material at least in its circumferential edge region, and the other, 2. continuous casting roll (2) is made of a steel material at least in its circumferential edge region. The copper material should have a thermal conductivity $\lambda_K$ of 230 to 260 W/m·K, and the steel material should have a thermal conductivity $\lambda_S$ of 30 to 40 W/m·K. Rejecting the prevailing idea that casting can only be performed with two continuous casting roll materials of the same kind, so as to ensure uniform crystal growth, a continuous casting roll pairing of steel and copper is provided in the present invention. In order to ensure a qualitatively high value casting microstructure, the difference in the thermal conductivity of the continuous casting rolls should not exceed a factor from 5 to 9. A ratio of thermal conductivity $\lambda_K$ of the copper material to thermal conductivity $\lambda_S$ of the steel material of 6:1 to 8:1 has proven particularly favorable.

20 Claims, 1 Drawing Sheet

CAST-ROLLING PLANT

BACKGROUND OF THE INVENTION

1. Field of the Invention

The invention relates to a cast-rolling plant for the continuous casting of metal strip, especially aluminum strip, which has two counterrotating continuous casting rolls, between which a gap is formed.

2. Description of Related Art

In cast-rolling, a fluid molten metal is cast between two continuous casting rolls that are rotating in opposite directions and are positioned horizontally, vertically or at an angle. In this operation, the strip solidifies between the two continuous casting rolls and is continuously advanced in the process.

So-called two-roller strip casting of aluminum strip is a method that has been applied for the past few years. Using this method, strip thicknesses are produced in the range of 1 mm to 10 mm. The method is characterized by two continuous casting rolls that are usually situated vertically above one another, between which a casting gap is produced that corresponds to the desired strip thickness.

Continuous casting rolls of the current type of construction have a cylindrical core, usually made of steel, which is used to guide cooling water, and a jacket connected to the core. In the cast-rolling of steel, substances of high heat conductivity, such as copper or copper alloys are usually employed as the material for the jacket. In the casting of nonferrous metals, steel jackets are normally used.

As material for the production of steel jackets, high-strength steels are used having alloy elements C, Mn, Ni, Cr, Mo, V, which, at room temperature, have strengths between 800 MPa and 1,200 MPa. The disadvantage of these materials is their limited heat conductivity, which usually lies in the range of 25 to 50 W/m·K.

Because of the low thermal conductivity of the steel jackets, achievable casting speeds are also limited. These days, depending on the alloy, casting outputs in the range of 0.7 to 1.2 t/m/h are reached. Auxiliary sets of machines of a casting-roll plant, such as melting and casting furnaces as well as coiling equipment are designed for these average casting speeds.

In the case of jackets made of copper or copper alloys, copper materials are predominantly used, having thermal conductivities in the range of 200 to 370 W/m·K. Especially when using special alloys based on copper as well as cobalt and beryllium is it possible to produce aluminum strip using copper continuous casting rolls, under production conditions.

Because the thermal conductivity of the copper alloys is up to ten times greater, considerably greater heat can be removed from the melt, so that substantially greater casting speeds are able to be reached on the cast-rolling plants. Up to this point, in experiments, casting outputs of 2.5 t/m/h to 2.8 t/m/h have been achieved.

Besides high strength and elongation limit ($R_p0.2 \geqq 450$ MPa), copper alloys suitable for continuous casting rolls additionally have to have high values for elongation A5.

A disadvantage when using continuous casting rolls having a copper jacket is the comparatively high cost of the continuous casting rolls, which are only amortized if there are correspondingly high casting outputs, which, however, is not always a given.

SUMMARY OF THE INVENTION

Accordingly, it is an object of the invention to raise the output of a cast-rolling plant particularly for the continuous casting of aluminum strip and of improving it with respect to cost.

These and other objects are attained, according to the invention, by a cast-rolling plant for the continuous casting of metal strip, especially of aluminum strip, which has two counterrotating continuous casting rolls (1, 2; 7, 8; 14, 15 ) between which a casting gap (4, 11) is formed, wherein a 1. continuous casting roll (1; 7; 14) is made of a copper material at least in its circumferential edge region, and the other, 2. continuous casting roll (2; 8; 15) is made of a steel material at least in its circumferential edge region.

BRIEF DESCRIPTION OF THE DRAWINGS

The invention will be described in greater detail with reference to the following drawings wherein.

DETAILED DESCRIPTION OF THE INVENTION

Figure 1:
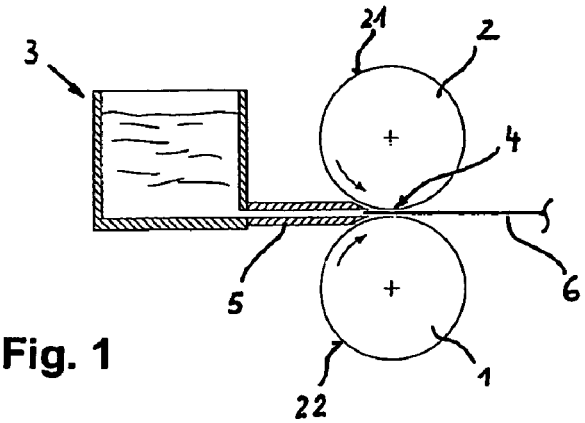
FIG. 1 shows a technically simplified manner of representation, the continuous casting roll equipment of a cast-rolling plant according to the present invention, FIG. 2 also shows a schematic, the two continuous casting rolls of a second specific embodiment.

The crux of the present invention is the use of different material pairings in the edge regions of the two continuous casting rolls that come into contact with the metal billet. According to the present invention, one of the two continuous casting rolls, at least in the edge region, is made of a copper material, as opposed to which the other, second continuous casting roll is made of a steel material, at least in the edge region.

Counter to the current thinking of professional experts, according to the present invention, two continuous casting rolls are combined that are made of materials having different thermal conductivities. In this way, cast-rolling plants are able to be operated at an optimal operating point for melt preparation and supply, casting output and coiling machines, which leads to an increase in productivity. Beyond that, the advantages of a cost-effective continuous casting roll made of steel may be used in combination with the high casting output of a copper roll, whereby equipment costs may be reduced.

Advantageous embodiments and refinements of this basic inventive idea are also described. Basically, the two continuous casting rolls may be made of solid material. That is to say that the first continuous casting roll is completely made of a copper material and the other, second continuous casting roll is completely made of a steel material.

However, advantageously each continuous casting roll has a cylindrical core made of a steel material, and an edge region connected to this in the form of a jacket, the jacket of the continuous casting roll 1 being made of the copper material and the jacket of the continuous casting roll 2 being made of the steel material.

Up to now, it was assumed that, for producing a workable aluminum strip casting microstructure, heat dissipation that is as homogeneous as possible has to occur in the casting gap of a cast-rolling plant. Accordingly, people worked only with continuous casting roll materials of the same kind, in order to ensure uniform crystal growth.

Deviating from this, the invention combines a copper continuous casting roll having a reduced thermal conductivity with a steel continuous casting roll. In this instance, the copper material should have a thermal conductivity of $\lambda_K$ of 200 to 370 W/m·K, particularly of 230 W/·K to 260 W/m·K, and the steel material should have a thermal conductivity $\lambda_S$ of 25 W/m·K to 50 W/m·K, particularly of 30 W/m·K to 40 W/m·K. The above-named thermal conductivities $\lambda_K$ of the copper materials, in combination with the required great strengths of $R_P0.2 \geqq 500$ MPa, are achieved especially by CuCoBe (copper, cobalt, beryllium) or CuNiBe (copper, nickel, beryllium) or CuNiSi (copper, nickel, silicon) alloys.

Although in continuous casting roll pairings of steel and copper a greatly different thermal dissipation from the casting gap comes about, when using such a pairing, a qualitatively high value casting microstructure ia able to be produced. This is possible especially if the difference in the thermal conductivity of the rollers does not exceed the factor 5 to 9. A ratio of thermal conductivity $\lambda_K$ of the copper material to thermal conductivity $\lambda_S$ of the steel material of 6:1 to 8:1 has proven particularly favorable.

At a ratio of the conductivities in a range of 5:1 to 9:1 of the continuous casting rolls, it is ensured that, in the cast strip, there will be no non-advantageous development of a segregation band that negatively influences the quality of the cast strip. The segregation band, into which the crystals grow from both sides, essentially remains in the center of the casting strand. An excessive precipitation of alloying elements along the cross section of the strip has also not been observed in practical experiments. Even a stalk-like development of crystals in the microstructure is avoided using roller pairings having the above-described parameters.

A particularly advantageous embodiment of the cast-rolling plant according to the present invention provides that the 1. continuous casting roll, that is, the copper continuous casting roll is used as the lower roller, since a greater quantity of heat has to be dissipated at the lower continuous casting roll.

It is also advantageous if the lateral surfaces of the continuous casting rolls have a surface roughness $R_A$ of 0.2 μm to 0.8 μm. Thereby an aluminum strip having high surface quality may be produced.

It has been shown that, by using continuous casting rolls having the above-named ratio of thermal conductivities, casting outputs in strip casting of aluminum alloys are able to be raised to values of 1.5 t/m/h to 2.5 t/m/h.

In an additional advantageous embodiment, the 1. continuous casting roll may have a coating of a material having a lower thermal conductivity with respect to the copper material. The coating is preferably made of nickel or a nickel alloy. Thereby the dissipation of heat from the process may be reduced via the continuous casting roll, so that even base materials having higher thermal conductivity may find application. Thermal conductivity $\mu_B$ of the coating should be less than 100 W/m·K. A thermal conductivity of $\lambda_B$ of the coating of 60 W/m·K to 80 W/m·K is regarded as being especially advantageous.

Furthermore, the coating should have a layer thickness of between 0.5 mm and 2.0 mm, particularly of 1.0 mm.

The hardness of the coating, especially of a nickel coating, should amount to between 180 HB and 420 HB. For practical purposes, a coating having a hardness of between 220 HB and 380 HB is regarded as being especially suitable.

Besides a coating made of nickel or a nickel alloy, coatings made of ceramic materials or of metallic materials may also find application as a spray coating, such as, for instance, MCrAlY. In MCrAlY, M stands for a metal, such as iron (Fe), nickel (Ni) or cobalt (Co) or a combination of these elements with chromium, aluminum and yttrium (Fe/Ni/CoCrAlY).

Basically, it is also conceivable that one might combine several layers with one another for reducing the thermal conductivity and for increasing the hardness of the first continuous casting roll, the outer jacket being the one in each case that should have the greatest hardness. Alternatively, or in combination with a coating, the lateral surfaces of the continuous casting rolls may be provided with a texture. The texturing may be generated, for example, by a mechanical action such as sand blasting and the like. Because of the textured surface structure of the continuous casting rolls, the heat transfer from the melt into the continuous casting rolls may be influenced.

To reduce the crown of the cast strip, the continuous casting rolls in the cast-rolling plant according to the present invention are preferably profiled differently. In order to compensate for the swelling of the continuous casting roll positioning, both continuous casting rolls are provided with a convex profile, the diameter crown in the middle of the rollers amounting to about 0.05 mm to 1.0 mm. In this context, because of the greater rigidity, the profile crown of the 2. continuous casting roll (the steel continuous casting roll) is less than the profiles crown of the 1. continuous casting roll (the copper continuous casting roll).

FIG. 1 shows, in a technically greatly simplified manner, the two continuous casting rolls 1, 2 of a cast-rolling plant for continuous strand casting or strip casting of aluminum strip, together with the assigned melting and casting furnace 3. The two continuous casting rolls 1, 2 are positioned one above the other, a casting gap 4 being set between the two continuous casting rolls 1, 2, which corresponds to the desired strip thickness.

The fluid aluminum melt stored in melting furnace 3 is guided to continuous casting rolls 1, 2 via a supply 5, and reaches continuous casting rolls 1, 2 that are counterrotating. In doing this, aluminum strip 6 solidifies between two continuous casting rolls 1, 2, and is then continuously guided further in the process.

In the equipment according to FIG. 1, the lower 1. continuous casting roll 1 is made of a copper material, whereas upper 2. continuous casting roll 2 is made of a steel material.

The 1. continuous casting roll 1, made of a copper material, has, according to the present invention, a thermal conductivity $\lambda_K$ of 230 to 260 W/m·K. The steel material of the 2. continuous casting roll 2 has a thermal conductivity $\lambda_S$ of 30 to 40 W/m·K.

Figure 2:
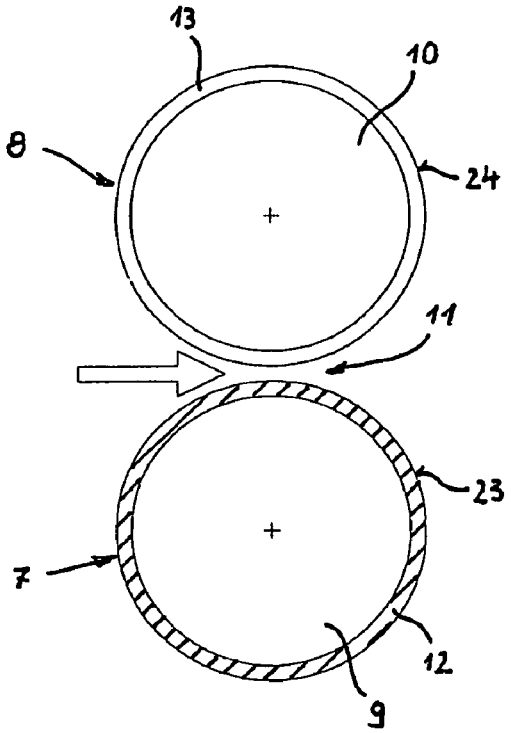

In continuous casting rolls 7, 8 of a cast-rolling plant shown in FIG. 2, each continuous casting roll 7, 8 has a cylindrical core 9, 10 made of a steel material. Between continuous casting rolls 7, 8 there is again formed a casting gap 11 corresponding to the desired strip thickness. The circumferential edge regions of each continuous casting roll 7, 8 are in each case formed by a jacket 12, 13. Jackets 12, 13 are as a rule shrunk onto the cores. Basically, however, other joining techniques, such as hipping [hot isostatic pressing] or mechanical clamping are also possible.

Figure 3:
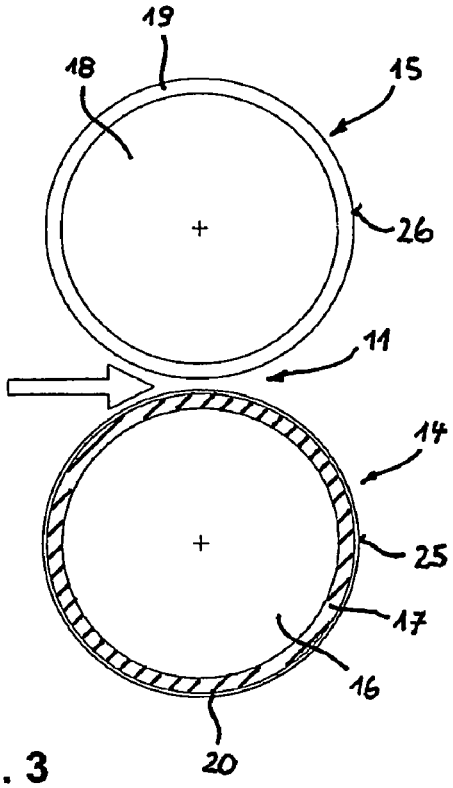
FIG. 3 shows the continuous casting rolls of a third specific embodiment.

Jacket 12 of lower 1. continuous casting roll 7 is made of a copper material, whereas jacket 13 of upper 2. continuous casting roll 8 is made of a steel material. In this specific embodiment, too, the copper material has a thermal conductivity of 230 to 260 W/m·K and the steel material has a thermal conductivity of 30 to 40 W/m·K. In practice, the thermal conductivity $\lambda_K$ of the copper material and the thermal conductivity $\lambda_S$ of the steel material should have a ratio to each other of 5:1 to 9:1, preferably of 6:1 to 8:1. The two continuous casting rolls 14, 15 shown in FIG. 3 are basically constructed in a manner equivalent to the ones explained above. Lower 1. continuous casting roll 14 has a cylindrical core 16 made of a steel material and a jacket 17 made of a copper material, whereas upper 2. continuous casting roll 15 is made of a steel material both as to core 18 and jacket 19. With respect to the characteristic variables concerning thermal conductivity, the information named according to the present invention apply.

The 1. continuous casting roll 14 is provided with a coating 20 made of a material having a lower thermal conductivity $\lambda_B$ as opposed to the copper material of jacket 17. In practice, coating 20 should have a thermal conductivity of less than 100 W/m·K, preferably of 60 to 80 W/m·K. Nickel or a nickel alloy finds use as the material for the coating. Coating with metallic or ceramic sprayed layers is also possible. In the case of a coating made of a metallic material, one thinks especially of a coating made of MCrAlY.

Coating 20 should have a layer thickness between 0.5 to 2.0 mm, a layer thickness of 1.0 mm being regarded as particularly advantageous in practice. Furthermore, coating 20, to the extent that it is developed as a galvanic nickel or nickel alloy, should have a hardness of 180 to 420 HB, preferably between 220 to 380 HB, whereby an effective wear protection is achieved, which has advantages for the service life of continuous casting roll 14.

In order to produce an aluminum strip having great surface quality, basically in all three exemplary embodiments described above the surface roughness of lateral surfaces 21–26 of continuous casting rolls 1, 2; 7, 8; 14, 15 should lie in a range between Ra 0.2 to 0.8 mm.

Furthermore, it is possible to influence the heat transfer from the aluminum melt to continuous casting rolls 1, 2; 7, 8; 14, 15 by texturing lateral surfaces 21–26 of continuous casting rolls 1, 2; 7, 8; 14, 15. In doing this, one gives lateral surfaces 21–26 of continuous casting rolls 1, 2; 7, 8; 14, 15 a topography matched to the desired heat transfer.

List of Reference Numerals

1—continuous casting roll
2—continuous casting roll
3—melting and casting furnace
4—casting gap
5—supply
6—aluminum strip
7—continuous casting roll
8—continuous casting roll
9—core
10—core
11—casting gap
12—jacket
13—jacket
14—continuous casting roll
15—continuous casting roll
16—core
17—jacket
18—core
19—jacket
20—coating
21—lateral surface
22—lateral surface
23—lateral surface
24—lateral surface
25—lateral surface
26—lateral surface

What is claimed is:

1. A cast-rolling plant for the continuous casting of metal strip, comprising: first and second counterrotating continuous casting rolls (1, 2; 7, 8; 14, 15 ) which define a casting gap (4, 11) therebetween wherein the first continuous casting roll (1; 7; 14) is made of a copper material at least in a circumferential edge region thereof, and the second continuous casting roll (2; 8; 15) is made of a steel material at least in a circumferential edge region thereof.

2. The cast-rolling plant according to claim 1, wherein each continuous casting roll (7, 8; 14, 15) has a cylindrical core (9, 10; 16, 18) made of a steel material and has an edge region connected thereto in the form of a jacket (12, 13; 17, 19), the jacket (12; 17) of the first continuous casting roll (7; 14) being made of the copper material and the jacket (13; 19) of the second continuous casting roll being made of the steel material.

3. The cast-rolling plant according to claim 1, wherein the copper material has a thermal conductivity of $\lambda_K$ of 200–370 W/m·K, and the steel material has a thermal conductivity $\lambda_S$ of 25–50 W/m·K.

4. The cast-rolling plant according to claim 1, wherein the copper material has a thermal conductivity $\lambda_K$ of 230–260 W/m·K, and the steel material has a thermal conductivity of 30–40 W/m·K.

5. The cast-rolling plant according to claim 1, wherein the thermal conductivity $\lambda_K$ of the copper material and the thermal conductivity $\lambda_S$ of the steel material are in a ratio to each other of 5:1 to 9:1.

6. The cast-rolling plant according to claim 1, wherein the thermal conductivity $\lambda_K$ of the copper material and the thermal conductivity $\lambda_S$ of the steel material are in a ratio to each other of 6:1 to 8:1.

7. The cast-rolling plant according to claim 1, wherein the first continuous casting roll (1; 7; 14) is situated below the second continuous casting roll (2; 8; 15).

8. The cast-rolling plant according to claim 1, wherein the continuous casting rolls (1, 2; 7, 8; 14, 15) have lateral surfaces (21–26) which have a surface roughness Ra of 0.2–0.8 μm.

9. The cast-rolling plant according to claim 1, wherein the first continuous casting roll (14) has a coating (20) made of a material having a lower thermal conductivity $\lambda_B$ than that of the copper material.

10. The cast-rolling plant according to claim 9, wherein the coating (20) has a thermal conductivity $\lambda_B$ of less than 100 W/m·K.

11. The cast-rolling plant according to claim 9, wherein the coating (20) has a thermal conductivity $\lambda_B$ of 60–80 W/mK.

12. The cast-rolling plant according to claim 9, wherein the coating (20) has a layer thickness of 0.5–2.0 mm.

13. The cast-rolling plant according to claim 9, wherein the coating (20) has a layer thickness of 1.0 mm.

14. The cast-rolling plant according to claim 9, wherein the coating (20) has a hardness of 180–420 HB.

15. The cast-rolling plant according to claim 9, wherein the coating (20) has a hardness of 220–380 HB.

16. The cast-rolling plant according to claim 9, wherein the coating (20) is made of nickel or a nickel alloy.

17. The cast-rolling plant according to claim 9, wherein the coating (20) is made of a ceramic or a metallic spray layer.

18. The cast rolling plant according to claim 9, wherein the coating (20) is made of MCrAlY.

19. The cast-rolling plant according to claim 1, wherein the continuous casting rolls (1, 2; 7, 8; 14, 15) have lateral surfaces (21–26) which are textured.

20. The cast-rolling plant according to claim 1, wherein the metal strip is an aluminum strip.

* * * * *